US009016490B1

(12) United States Patent
Higgins

(10) Patent No.: US 9,016,490 B1
(45) Date of Patent: Apr. 28, 2015

(54) MODULAR CONTAINER SYSTEM

(76) Inventor: Earle B. Higgins, Bingham Farms, MI (US)

( * ) Notice: Subject to any disclaimer, the term of this patent is extended or adjusted under 35 U.S.C. 154(b) by 287 days.

(21) Appl. No.: 12/395,867

(22) Filed: Mar. 2, 2009

Related U.S. Application Data

(60) Provisional application No. 61/032,911, filed on Feb. 29, 2008.

(51) Int. Cl.
*B65D 88/12* (2006.01)

(52) U.S. Cl.
CPC ..... *B65D 88/12* (2013.01)

(58) Field of Classification Search
CPC .... B65D 88/025; B65D 90/004; B65D 88/52; B65D 88/121; B65D 88/12
USPC ..... 220/1.5, 6, 23.87, 23.86; 211/71.01; 105/355
See application file for complete search history.

(56) References Cited

U.S. PATENT DOCUMENTS

| | | | | |
|---|---|---|---|---|
| 4,884,935 | A * | 12/1989 | Smith et al. | 414/498 |
| 5,265,748 | A * | 11/1993 | Furukawa | 220/1.5 |
| 2001/0038009 | A1 * | 11/2001 | Payne | 220/1.5 |
| 2009/0026196 | A1 * | 1/2009 | Leedekerken | 220/1.5 |

* cited by examiner

*Primary Examiner* — Stephen Castellano

(57) ABSTRACT

A device suitable for use with a car-hauling container such as a car-hauling rail car or shipping container that can be used to transport various goods in heretofore unutilized empty car-hauling containers and an integrated system employing the same. The device includes a base member configured to engage the vehicle supporting floor of an associated automobile car-hauling container. The device also includes a pair of opposed sidewalls pivotally mounted to the base moveable between a first orientation perpendicular to the base and a second orientation in overlapping relationship to each other and to the base member as well as a pair of opposed endwalls pivotally mounted to the base. The pair of opposed endwalls are moveable between a first orientation perpendicular to the base and a second orientation in overlying relationship to the sidewalls and in side-by-side relationship to each other. The device also includes a roof member that is moveable between a first orientation parallel to the base member and a second storage orientation.

7 Claims, 8 Drawing Sheets

MODULAR CONTAINER SYSTEM

The present invention claims the benefit of U.S. Ser. No. 61/032,911 filed Feb. 29, 2008, the specification of which is incorporated by reference herein.

The present invention pertains to modular container systems. More particularly, the present invention pertains to modular container systems suitable for use with specifically designed and configured car-hauling container systems.

Automotive vehicles are manufactured and assembled at a variety of locations. In order to be transported from the assembly point to the dealer and ultimate consumer, the car vehicles must be conveyed in a safe and secure manner that preserves the "like-new" nature of the vehicle. In order to transport newly assembled vehicles, the various cars are typically loaded into container devices such as rail cars or, in the case of overseas transport, specifically configured closed containers. The standard car-hauling railroad container is an enclosed container that, for purposes of this summary, can be either affixed or mounted on a suitable rail car. For purposes of this disclosure, other type devices include specifically configured rail cars.

The car haulers typically have a "double-decker" structure with suitable anchors to hold the cars in place in the structure during transport. In this manner, cars can be transported on two or more tiers and can be completely enclosed from view as well as from the elements and potential theft, vandalism, and the like. Car haulers can be configured to permit surface loading or one-sided loading as desired or required.

These car-hauling devices provide a desirable method for moving large numbers of cars from an assembly point to an end-use destination. However, the car-hauling railcar as well as car-hauling containers must be transported back to the assembly locations empty. The interior of the car-hauling rail car or container is so specialized that loading the empty container with anything other than assembled vehicles proves to be difficult if not impossible. This is due, at least in part, to the confined spaces defined by the double-decker arrangement of the car-hauling containers and rail cars. Additionally, such rail cars need to be maintained in a suitably clean environment to ensure that newly assembled cars arrive at their destination in optimum condition.

It can readily be appreciated that costs associated with transporting any device, either overland or by water, have been continually mounting. Thus, the costs of returning empty car-hauling devices such as rail cars or containers to their destinations takes an incredible toll in both time and resources, not the least of which is fuel.

SUMMARY

Disclosed herein is an integrated device suitable for use with a car-hauling container such as a car-hauling rail car or shipping container that can be used to transport various goods in heretofore unutilized empty car-hauling containers as well as a car hauling device and system employing the same.

The device disclosed herein includes a base member. The base member is configured to engage the vehicle supporting floor of an associated automobile car-hauling container. The device also includes a pair of opposed sidewalls pivotally mounted to the base. The opposed sidewalls are moveable between a first orientation perpendicular to the base and a second orientation in overlapping relationship to each other and to the base member. The device also includes a pair of opposed endwalls pivotally mounted to the base. The pair of opposed endwalls is moveable between a first orientation perpendicular to the base and a second orientation in overlying relationship to the sidewalls and in side-by-side relationship to each other. The device also includes a roof member that is moveable between a first orientation parallel to the base member and a second storage orientation.

DESCRIPTION OF THE DRAWINGS

The description herein makes reference to the accompanying drawing figures wherein like reference numerals refer to like parts throughout several views and wherein.

DESCRIPTION

Figure 1A:
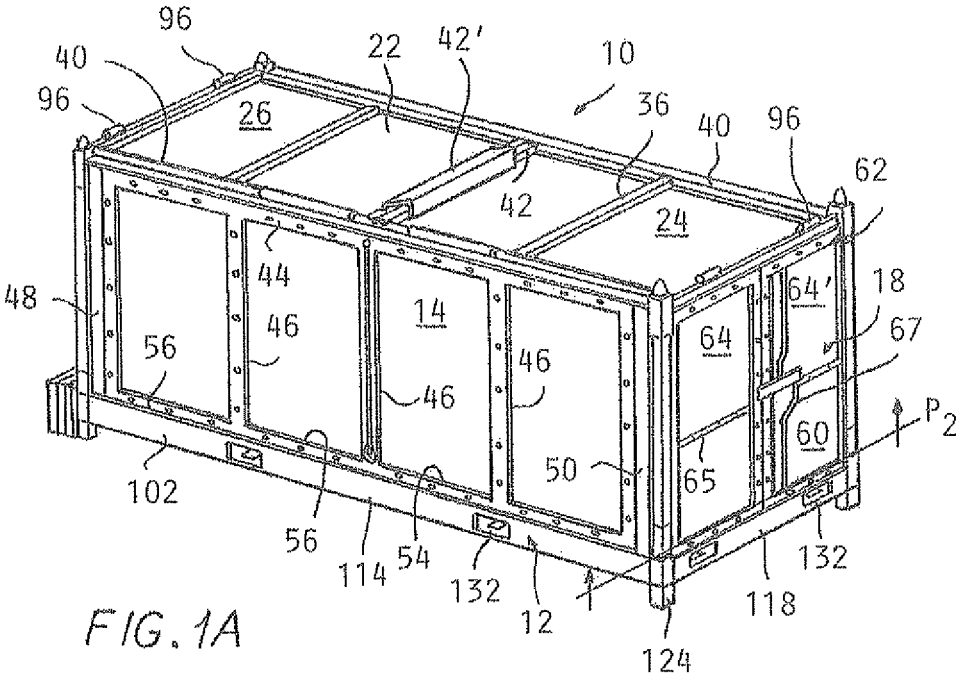
FIG. 1A is a perspective view of an embodiment of the container disclosed herein.

In the modern automotive industry, automotive components can be produced at locations far removed from the point of final vehicle assembly. For instance, engines may be assembled on one continent, transmissions on another, and both can be far removed from the final vehicle assembly operation location. These components must be transported by water and overland in a safe and secure manner to reach their destinations for ultimate final assembly. Many times, such transportation needs can require the use of disposable or consumable packaging materials so that the various components remain safe and accounted for, unharmed by dirt or the surrounding environment or any other reason. It can be appreciated that disposable or consumable packaging materials can be costly and can their use can place an undesirable strain on the environment from both a manufacturing and a disposal standpoint.

Transport of parts to final destination centers also incurs transport and material costs. Such transpiration costs in fuel and vehicular usage may be a necessity, however reduction or minimization of such transudation costs would be highly desirable. All such costs, both for the moving of assembled vehicles and accumulating the necessary component parts add up in both fuel consumed, time spent, and labor expended.

For example, assembled automotive vehicles such as passenger vehicles are moved from various assembly factories to their points of sale via various specially adapted and configured car hauling containers. Because they are specifically adapted to transport automotive vehicles, heretofore they have not been considered adaptable for other uses. Once the vehicles have been delivered, the car hauling containers are returned empty to the assembly plants for reuse. Thus, almost 50% of the time the car hauling containers are in transit the devices are "dead-headed" or empty.

Disclosed herein are both an integrated device for transporting vehicles as well as component vehicle parts in dedicated rail cars and/or shipping containers. Such dedicated rail cars and/or shipping containers are generally referred to herein as car-hauling containers. It is to be understood that such "car-hauling containers" can be configured as rail cars or containerized units for use on flatbed rail cars, transoceanic ships, and the like. The "car-hauling containers" will include at least one automotive vehicle supporting floor. The automotive vehicle supporting floor will be configured to maintain the associated automotive vehicle in secure position during transport. In various car-hauling containers, it is expected that the device will be configured as a "double-decker" unit, i.e., the device will have at least two vehicle supporting floors in spaced overlying relationship to one another so that the associated device can haul approximately double the number of vehicles.

Typically, the car-hauling containers will define an interior surrounded by walls, roof, and the like. The car-hauling container can be accessed by one or more doors that are typically located on the front and/or rear of the car-hauling container so that vehicles can be rolled or driven into position therein. The car-hauling container device will have suitable elements or chucks to maintain the vehicles in secure relationship relative to the vehicle supporting floor. Such devices will be described in greater detail subsequently. The interior may be completely or partially enclosed as desired to required.

The integrated device for transporting automotive vehicles and unassembled parts includes a car hauling container device comprising at least one reusably collapsible container removably insertable in an interior defined in the car hauling device in at least one car transporting positions defined therein. It is contemplated that multiple collapsible container devices can be positioned in the integrated device in the uncollapsed position instead of or in addition to assembled vehicles in order to transport various unassembled items such as automotive components and the like. Where desired or required, it is contemplated that the collapsible container device(s) can oriented in the collapsed position and can be formed into a suitable stack that includes at least two collapsed container devices in fixed overlying relationship one to the other to facilitate transport of the empty container devices to a suitable location.

Figure 1B:
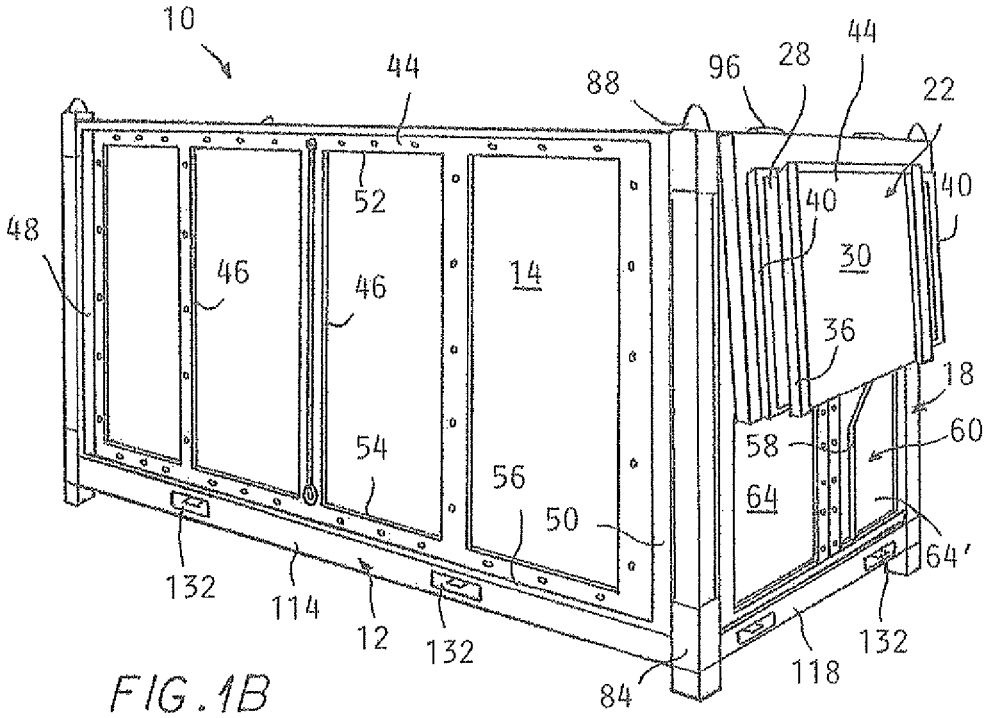
FIG. 1B is perspective view of the embodiment of the container of FIG. 1A with the roof in the open configuration.

Also disclosed herein is a container device 10 that can be removably positioned in a car-hauling container device having a vehicle supporting floor. One embodiment of such as device is depicted in FIGS. 1A and 1B. The container device 10 includes a base member 12 configured to overlie and engage the vehicle supporting floor of the automotive car-hauling container device. The container device 10 also includes a pair of opposed sidewalls 14, 16 pivotally mounted to the base member 12. In the embodiment depicted, the opposed sidewalls 14, 16 are pivotally mounted in a manner that permits them to be moveable between a first orientation perpendicular to the base 12 and a second orientation in overlapping relationship to each other and in overlying relationship to the base member 12.

The container device 10 also includes a pair of opposed endwalls 18, 20. The opposed endwalls 18, 20 are movable between a first orientation that is perpendicular to the base member 12 and a second orientation in overlapping relationship to the sidewalls 14, 16. In the embodiment depicted in the FIGS. 1A and 1B, the endwalls 18, 20 are configured to be positionable in side-by-side relationship to one other in the second or collapsed position.

The container device 10 also includes at least one roof member such as roof member 22 that is configured to overlie the container device 10 in the noncollapsed orientation and to define an interior cavity with the respective sidewalls 14, 16 and endwalls 18, 20. It is contemplated that the roof member will be configured to be moveable between a first orientation that covers the container device and a second collapsed orientation. In the embodiment depicted in the drawing figures, roof member 22 includes a pair of separate roof panels 24, 26. However, it is contemplated that other configurations for the roof member 22 can be considered within the purview of this disclosure. Nonlimiting examples of alternate roof configurations may include various detachable roof elements In the embodiment depicted in the FIGS. 1 and 2, each roof panel 24, 26 is pivotally attached to an associated endwall 18, 20 at a location opposed to the point of connection between the respective end wall 18, 20 and the base member 12. The respective roof panels 24, 26 are pivotal between a first orientation in which the respective roof panel 24, 26 is parallel to the base member 12 and a second orientation in which the respective roof member 24, 26 is essentially parallel to the associated respective endwall 18, 20. It is contemplated that each roof panel 24, 26 is positionable in overlying relationship with the associated respective endwall 18, 20 when the associated endwall is in its second or collapsed orientation.

The roof panels 24, 26 can have any suitable configuration as desired or required to define the interior cavity desired. Where desired or required, it is contemplated that each respective roof panel 24, 26 can be composed of subpanels 28, 30 that are foldably engageable against one another in a manner such as that depicted in FIGS. 1A and 1B. Where desired or required, the respective roof subpanels can be joined to one another by a suitable device such as longitudinal hinge device 32 to permit removable, foldable releasable engagement between the subpanels 28, 30 as in the collapsed position. The respective subpanels 28, 30 can be held in engagement with one another by any suitable attachment mechanism. In the embodiment depicted, the attachment mechanism is a suitable longitudinal ribbon of a mating hook-and-eye fastening element 31 such as VELCRO. However, various fastening mechanisms are contemplated herein. The fastening mechanism 34 can be positioned at any suitable location relative to the roof subpanels 28, 30.

It is contemplated that the roof member as well as the various sidewalls and endwalls will be constructed of a suitable structural material that will be both lightweight and durable. Suitable materials include, but are not limited to, particle board, various polymeric matrixes, and the like. The materials chosen can be those that provide sufficient structural integrity to the container device 10 in the uncollapsed orientation without unduly adding additional weight to the device.

The roof member 22 may also include suitable reinforcement members as desired or required to enhance the structural integrity of the associated roof member. These can include, but are not limited to various central struts and the like such as reinforcement bars 36. The reinforcement bars 36 can be composed of suitable material that can provide suitable stiffness and structural support to the structural wall member material 38. In the embodiment depicted in FIG. 1, it is contemplated that a suitable metal such as iron or steel can be employed. However it is considered within the purview of the present disclosure to employ reinforcements made of various metals and/or synthetic materials such as structural polymers composites and the like to provide suitable stiffness and support to the associated element and to the resulting structure in the collapsed and/or uncollapsed orientations.

It is also contemplated that the roof panels 24, 26 of roof member 22 will include suitable opposed side elements 40 to contact and releasably engage appropriate regions on the associated sidewalls 14, 16 in a suitable mating manner. Similarly, the end element 42 will be configured to releasably engage an associated end element 42 on the respective opposed roof panel when the respective panels 24, 26 are in spaced overlying relationship with the base member 12. It is contemplated that the opposed side elements 40 and the respective end elements 42 will be brought into engagement in a manner that and can reinforce the structural integrity of the assembled container device 10 and/or prevent or minimize unauthorized access into the interior of the container device, particularly at the junction between the respective sidewall and the respective roof subpanel. Non-limiting example of those configurations will be described subsequently.

It is contemplated that in many various embodiments of the container device 10, the sidewalls 14, 16 are essentially rectangular in configuration and have dimensions equal to or slightly less than corresponding outer dimensions of the base member 12. The sidewalls 14, 16 can be composed of any suitable structural material such as the materials employed in the roof member 22. While in the embodiment disclosed, it is contemplated that the sidewalls 14, 16 will be constructed of a material that is the same or similar to the wall material employed in the roof panels 24, 26, it is also to be considered within the purview of this invention to employ different wall materials as desired or required. It is envisioned that the device 10 will be dimensional to fit efficiently into a suitable car-hauling container in its collapsed state. It is further envisioned that the device 10 will have suitable wall base and roof thicknesses to collapse to provide a stackable device that can be stacked with other collapsed devices to fit efficiently in the associated container or rail car in the collapsed, stacked state. One non limiting example of suitable dimensions is 46.75"×96"×125" for the sides; 96"×48"×5" for the Floor; 21.5"×44.75'×0.125" for the doors; 24.25"×51.125"×0.125" for one panel of the roof and 26.75"×51.125"×0.125" for the mating roof panel.

The sidewalls 14, 16 can be constructed of material that is suitably structurally reinforced or can include suitable structural reinforcements as desired or required. It is also contemplated that the sidewalls, 14, 16 can also include suitable engagement members to facilitate engagement between the various edges of the sidewalls 14, 16 and the other various elements of the collapsible container device 10.

In the embodiments depicted in FIGS. 1A and 1B, the sidewalls 14, 16 include an outer support frame 44 located along the outer periphery of the respective sidewall 14, 16. The outer support frame 44 can be composed of any suitable material that will provide or enhance the structural support of the respective sidewall 14, 16 and/or can reduce wear and tear as the respective elements engage one another. In the embodiment disclosed herein, the outer support frame 44 is a suitable structural metal such as steel however it is contemplated that other materials can be employed in various applications.

The respective sidewalls 14, 16 can also include means for enhancing the structure of the respective sidewall 14, 16. In the embodiment depicted in FIG. 1, the side wall 14, 16 includes at least one suitable intermediate support bar 46 positioned as desired or required to enhance the structural support and stability of the associated sidewall 14, 16. In the embodiment depicted in the drawing figures, the sidewalls 14, 16 include three intermediate support bars 46 spaced in equidistant relationship along the length of the respective sidewall 14, 16. Other orientations and bar configurations are considered to be within the purview of this disclosure.

In the embodiments depicted in FIGS. 1A and 1B, the intermediate support bar(s) 46 are positioned on the face of the side wall that becomes the exteriorly oriented surface of the respective sidewall 14, 16 when it is in its uncollapsed orientation. It is also considered to be within the purview of this disclosure to position the support bars on the interior surface of the respective side wall 14, 16, if desired or required. Similarly, it is contemplated that the intermediate support bar(s) 46 can be contained within the structure of the wall, if desired or required. While the support bars are depicted as a plurality of supports, it is also considered within the purview of this invention to provide other structural features as desired or required to maintain the structural integrity of the respective sidewall 14, 16.

In the embodiments depicted in FIGS. 1A and 1B, the structural support bar(s) 46 communicate with the support frame 44 to form an integrated support structure. The various elements can be constructed as integral elements or can be constructed joined by bolting welding or other suitable joining methods. Similarly, elements such as the support bar(s) 46 and the support frame can be attached to wall elements by any suitable method. Such methods include, but are not limited to riveting, bolting and the like.

The outer support frame 44 of the respective sidewall 14, 16 can be a unitary member or can be composed of separate elements as desired or required. In the embodiment as depicted in FIG. 1, it is contemplated that the outer support frame is composed of individual elements joined together by welding or the like. The various elements can have any suitable cross-sectional profile of which an essential tubular or circular profile is but one non-limiting example.

In the embodiments as depicted in FIGS. 1A and 1B, the outer support frame 44 includes opposed side members 48, 50 that are disposed perpendicular to the base member 12 when the container device 10 is in the noncollapsed or in-use position. The opposed side members 48, 50 can have suitable end geometry configured to releasably and engageably contact respective regions of the associated endwalls 18, 20 in a manner that prevents or deters incursion into the interior of the container device 10 by individuals or undesirable aspects of the external environment. The side members 48, 50 can be configured as tubular members and can have an essentially circular cross section if desired or required. Various manners of engagement between the various elements of the container device disclosed herein are contemplated and will be described in greater detail subsequently.

The outer support frame 44 of side walls 14, 16 also include opposed upper and lower sidewall support members 52, 54. In the embodiment disclosed in FIG. 1, the upper and lower sidewall support members 52, 54 are interconnected with the opposed side members 48, 50 as well as with intermediate support bars 46 to provide multiple regions of reinforcement to the extended side wall 14, 16. The upper sidewall support member 52 is configured as elongated tubular member that extends from one opposed side to the other. When the respective sidewall 14, 16 is in the first perpendicular position, the upper sidewall support member 52 defines an engaging surface on which the roof member 22 can rest.

In the embodiments as depicted in FIGS. 1A and 1B, the roof panels 24, 26 can be brought into releasable engagement with the upper sidewall support member 52 by any suitable manner. In the embodiments depicted, the respective roof panel members 24, 26 are pivoted about suitable hinge members 96 into resting engagement on the respective upper sidewall support members 52. The side elements 40 of respective roof panel 24, 26 can be configured as U-shaped channels having dimensions suitable to releasably engage and surround the tubular upper sidewall support member 52. Where desired or required, the U-shaped channels can provide suitable regions of friction fit between the channel and the upper support member. However, it is also contemplated that the U-shaped channel can be dimensioned to provide a suitable lip to overlay at least a portion of the associated upper sidewall support member 52 and maintain it in perpendicular orientation relative to the base member 12.

The lower sidewall support member 54 can be configured in any suitable manner to provide support to the associated sidewall 14, 16. The lower sidewall support member 54 can be tubular or flat as desired or required. It is contemplated that the lower sidewall support member 54 will be configured with one or more hinge mechanisms that can be integrally attached thereto. The hinge mechanisms can be connected to suitable hinge elements fastened to or connected with the base member 12 in a suitable manner.

In the embodiments depicted, it is contemplated that hinge mechanisms 56 can be positioned relative to the base member 12 and the respective sidewall 14, 16 such that the sidewall can pivot inward from an upright perpendicular first position to a second orientation in which the sidewall 14,16 is in overlying relationship to a central portion of base member 12. (See FIG. 16) Where desired or required, the hinge mechanism 56 can be joined to that lower sidewall support such that the lower sidewall support 54 rotates around the hinge mechanism 56 from the lower or second collapsed position into the first or perpendicular position and vice versa. It is contemplated that such eccentric pivoting can serve to maintain the associated sidewall 14, 16 in the perpendicular position temporarily during the container assembly operations.

It is contemplated that the respective sidewalls will be similarly configured so that both can pivot from a first orientation perpendicular to the base 12 to a second orientation in sidewall 14 is in overlapping relationship with sidewall 16. It is contemplated that this second orientation is employed in the collapsed storage mode of the container device 10. When the sidewalls 14, 16 are in the second collapsed or storage orientation, it is contemplated that the respective sidewalls are in overlapped orientation relative to one another. Where desired or required, it is contemplated that the height of the sidewalls 14, 16 will be slightly less than the width of the associated base member 12. In this way the overlapped sidewalls 14, 16 will be slightly skewed relative to one another such that the upper sidewall support member 52 of sidewall 16 is positioned at least slightly interior of the lower sidewall support member 54 of sidewall 14 and vice versa. Without being bound by any theory, it is believed that this orientation permits better packaging of the respective sidewalls 14, 16 in the collapsed orientation.

The hinge mechanism(s) 56 for the respective sidewalls 14, 16 can be positioned at a height relative the base member 12 that permits and facilitates perpendicular positioning in the first uncollapsed orientation. The position and configuration of the hinge(s) 56 can also be such they assist in the positioning of the respective sidewalls 14, 16 in the second or collapsed orientation. It is contemplated that the hinge(s) 56 for the respective sides walls 14, 16 can each be at the same height relative to the base 12. Alternately, it is contemplated that the hinge(s) 56 for the associated sidewalls 14, 16 can be at slightly different heights to facilitate overlapping when the sidewalls 14, 16 are in the collapsed position. Where the heights of the respective hinges differ slightly, the heights of the respective sidewalls 14, 16 are adjusted to provide even height when the respective sidewalls 14, 16 are in the perpendicular orientation. Thus, it is contemplated that the sidewalls can be in either flat overlying relationship in the collapsed orientation or can be in a slightly interleaved relationship in which the upper sidewall support member of the uppermost sidewall in the collapsed orientation is suspended slightly above the surface of the associated lower oriented sidewall.

Figure 2A:
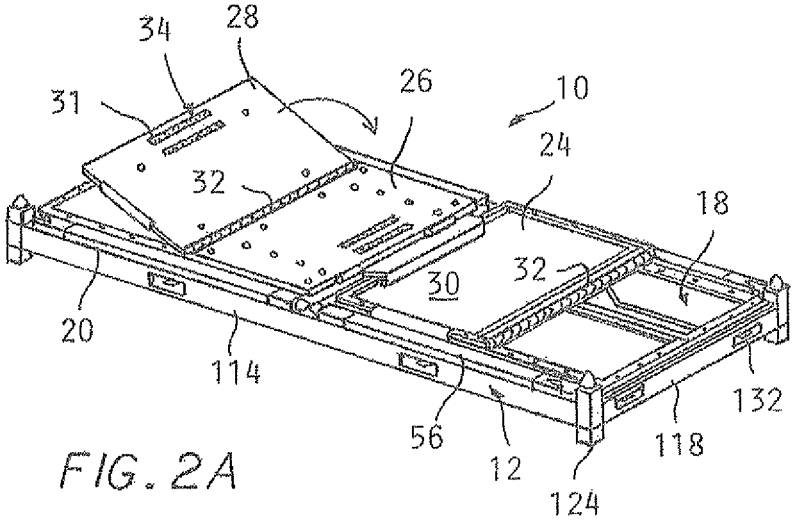
FIG. 2A is a perspective view of the embodiment as depicted in FIG. 1A in the collapsed position.
Figure 2B:
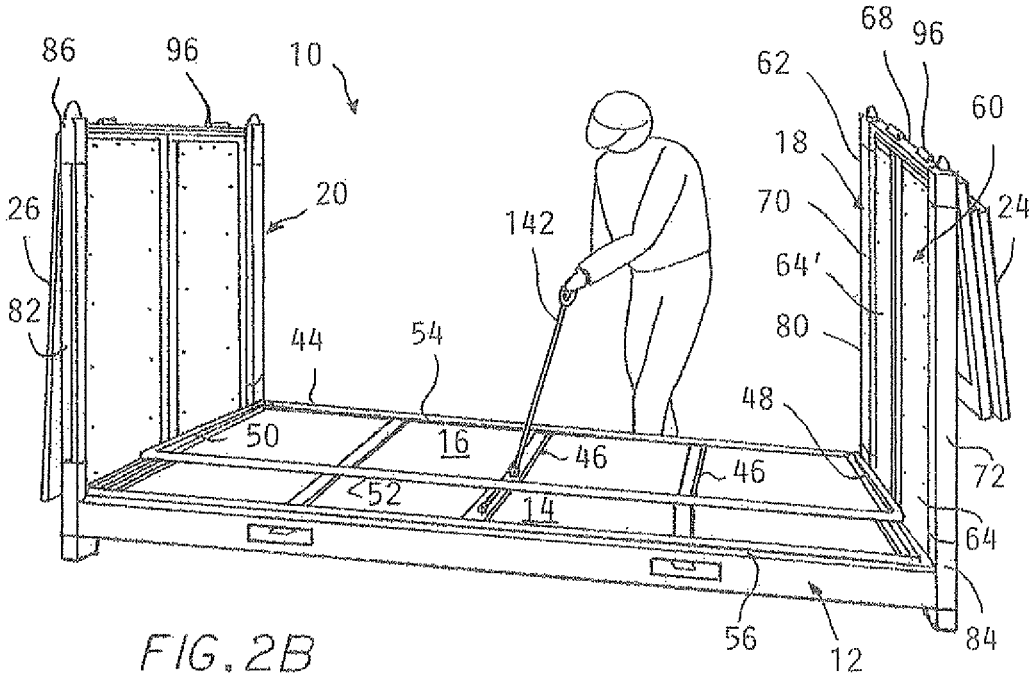
FIG. 2B is a perspective view of the embodiment as depicted in FIG. 1A with side walls in the collapsed position.
Figure 3:
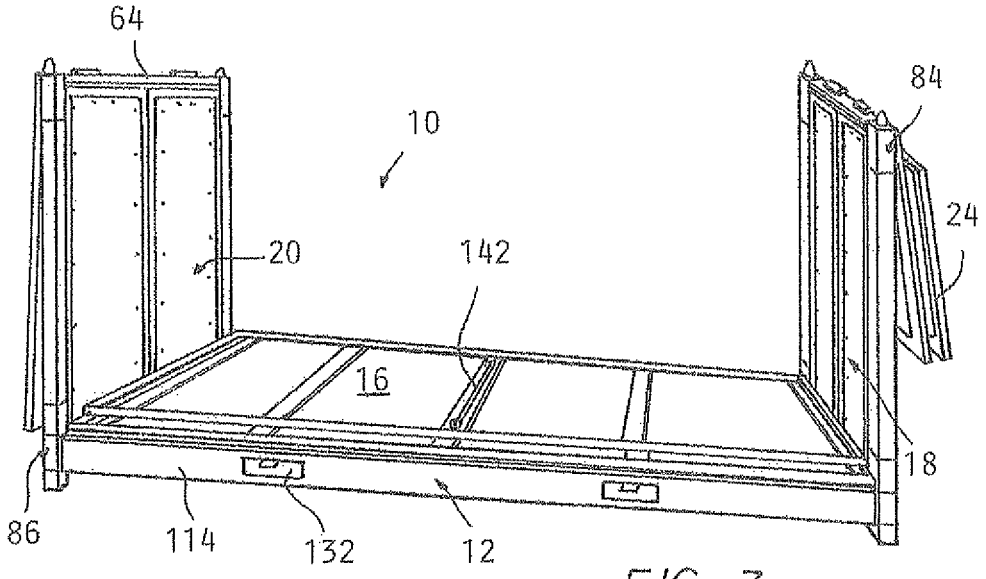
FIG. 3 is a photographic representation an essentially side view of the embodiment of FIG. 1 with roof panel 24 in the folded subpanel orientation.
Figure 4:
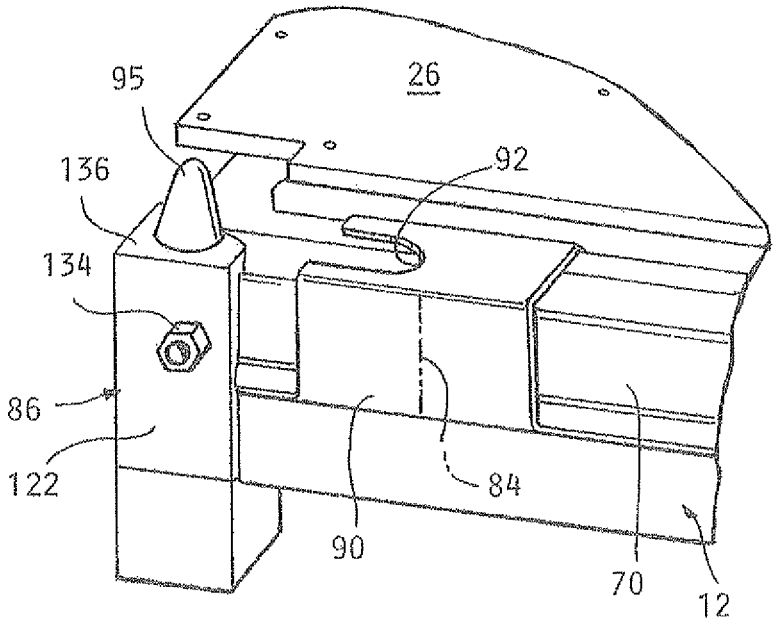
FIG. 4 is a photographic depiction of a detail of a corner section of an embodiment of the collapsible container device as depicted herein shown in the collapsed position.
Figure 5:
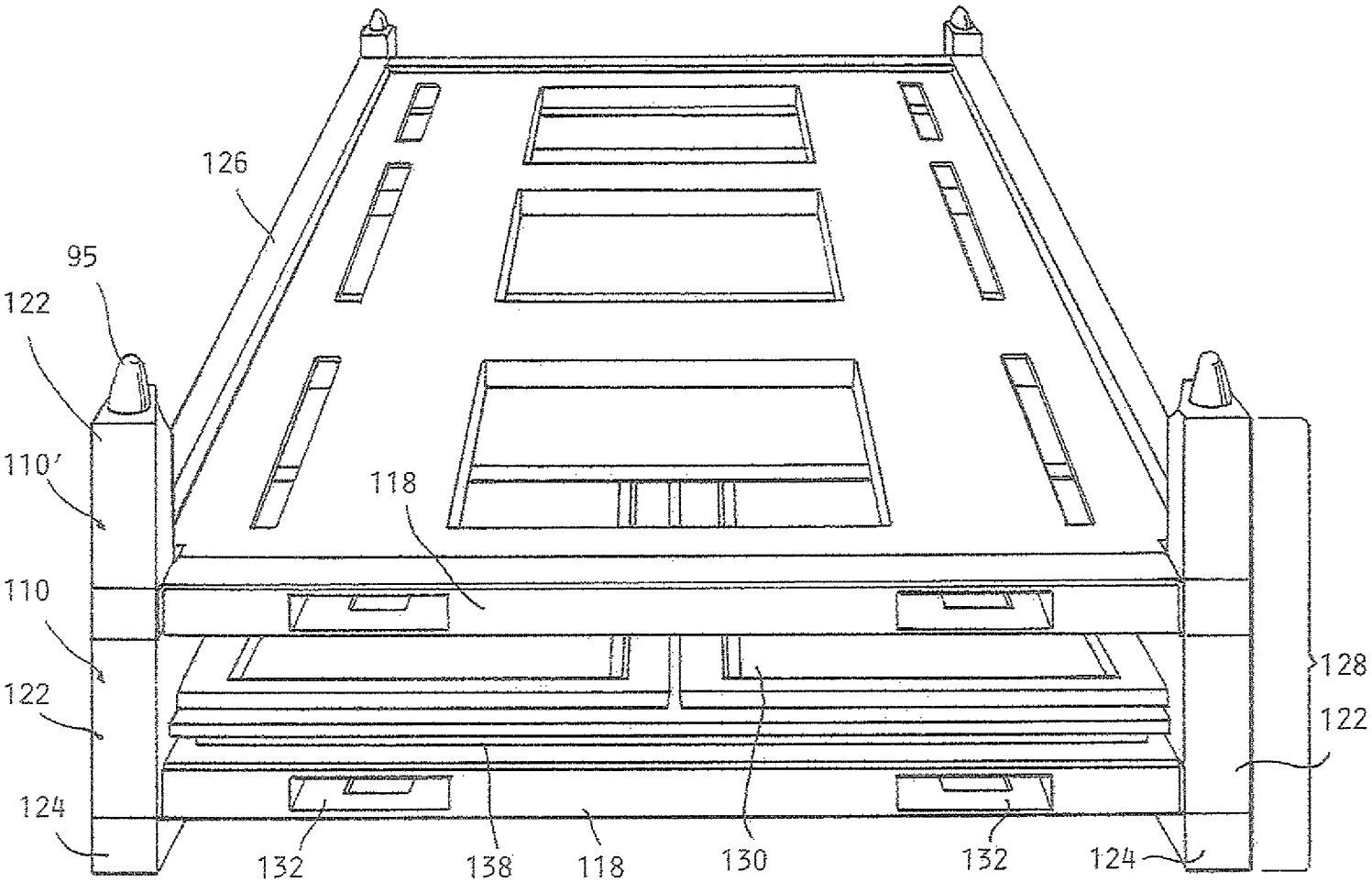
FIG. 5 is a side view of the collapsed containers as depicted in FIG. 1 in the stacked configuration.

In the embodiments depicted in FIGS. 1 and 2, the sidewalls 14, 16 are configured to be the walls that are positioned proximate to the base member 12 when the container device 10 is in the collapsed orientation. It is to be considered within the purview of the present disclosure that the container device 10 as disclosed herein can be configured to accommodate the initial lowering of the end wall members if desired or required.

The sidewall 14, 16 can be equipped with suitable mechanisms to facilitate the pivotal movement of the sidewall 14, 16 relative to base member 12. Such mechanisms include, but are not limited to, various handles, pulls, and the like, such as handle 58 associated with pull bar 142 as depicted in FIG. 2. Where desired or required, the container device may be outfitted with suitable auxiliary braces to maintain the sidewall 14, 16 in the perpendicular orientation during the container assembly process, however, it is believed that the hinge and sidewall configuration disclosed herein, either alone or on combination with the endwall configurations disclosed herein can achieve temporary stability of the respective sidewalls collapse and reconstruction.

The container device also includes endwalls 18, 20. The endwalls, 18, 20, are configured for pivotal movement between a first orientation perpendicular to the base member 12 and a second orientation in which the respective endwalls 18, 20 are in overlying relationship with the base member 12. In the embodiment as depicted in the FIGS. 1 and 2, the endwalls 18, 20 are configured to be overlying relationship to the respective sidewalls 14, 16 when the end walls are positioned in the second or collapsed orientation. While the embodiment depicted discloses a second storage orientation in which the first and second sidewalls 14, 16 are positioned proximate to the base member, it is considered within the purview of this disclosure that the relationship can be inverted in certain situations.

In the container device disclosed herein, at least one of the endwalls 18, 20 or side walls 14, 16 can be configured with a suitable access portal such as access door 60. The access door 60 can be of any suitable configuration to facilitate access to the interior compartment defined by the container device 10. In the embodiment depicted in drawing FIGS. 1 and 2, the access door in located on at least one of the two endwalls 18, 20, however it is considered with in the purview of this disclosure to position access doors on at least one sidewall 14, 16 instead of or in addition to the access door 60 is located on or defined in endwalls 18, 20.

In the container device 10 as disclosed herein, one or more endwalls 18, 20 can be configured with a suitable access door 60 to provide access to the interior compartment defined in the container device 10 when the device is in the noncollapsed orientation. The access door 60 is configured integral to the endwall to facilitate pivotal movement of the access door and the associated endwall 18, 20 when the respective end wall is moved between the collapsed and uncollapsed orientation. Details of the access door configuration will be described subsequently.

The endwalls 18, 20 are each configured to include suitable structural elements to facilitate pivotal movement relative to the base, reinforce the associated endwall, etc. In the embodiment depicted in FIGS. 1 and 2, the endwalls 18, 20 each include a structural frame member 62 configured to contain at least one wall panel member such as wall panel member 63. Wall panel member 63 can be composed of a suitable aggregate, polymeric material or the like, typically chosen for provide sturdy, relatively lightweight structural coverage across the area defined by the respective endwall 18, 20. Non-limiting examples of suitable panel materials include those previously discussed in conjunction with the sidewalls 14, 16.

In various embodiments of the container device 10 as disclosed herein, the endwall 18, 20 connected to the base member 12 in spaced opposed relationship to one another at locations proximate to the periphery of the base member. Generally the endwalls 18, 20 are pivotally mounted to an associated end similarly dimensioned region of base member 12. In various embodiments, it is contemplated that the structural frame 62 composed of wall panel member 63 can be pivotally mounted to base member 12.

In the embodiment depicted in FIGS. 1 and 2, at least one of the endwalls 18, 20 is configured with at least one access door 60. the access door mechanism 60 is moveably mounted within structural frame 62. As depicted therein, the access door member 60 is composed of two mating panels 64, 64' that can pivot outward relative to structural frame 62. The mating panels 64, 64' can be configured to include suitable reinforcement elements 65 and can also include a suitable locking mechanism such as mechanism 67 that is configured to slidingly engage suitable slots defined in the associated structural frame 62 to hold the mating panels 64, 64' in closed engagement relative to the structural frame 62 when the container device 10 is in the first, uncollapsed orientation. The locking mechanism 67 can also be one that can work to maintain the mating panels 64, 64' in planar engagement during pivotal movement between the perpendicular orientation and the collapsed orientation, if desired or required. Other suitable engagement mechanisms can be contemplated and are considered within the purview of this disclosure.

In the embodiment disclosed herein, the structural frame 62 includes a lower lateral bar 66, an opposed upper lateral bar 68, and a pair of opposed side bars 70, 72 contiguously joined to the lower lateral bar 66 and opposed upper lateral bar 68. The respective side support bars 70, 72 are configured to include a first mounting surface on hinge element(s) 76 can be positioned such as mounting surface 74. In certain embodiments, it is contemplated that the mounting surface 74 can be oriented to be in an outwardly facing orientation when the container device 10 is in the uncollapsed position. Hinge element(s) 76 can be mounted in outwardly projection orientation thereon. It is contemplated that the respective side support bars 70, 72 can be configured with one or more hinge elements with the size and number of hinge elements associate with a given support bar 70, 72 being that number capable of securely fastening the associated door panel 64, 64' to the structural fame 62. In the embodiment depicted in FIG. 1A, the structural frame 62 has two to three elements 76 in spaced relationship thereon.

The hinge element(s) 76 matingly engage hinge elements 78 attached or affixed to the associated opposed panels 64, 64' of the access door 60. The hinge elements 76 and mating hinge elements 78 on the opposed panels 64, 64' can be configured to permit outward swing of the access door elements when the container device 10 is in the uncollapsed orientation. The degree of travel or arc of the opposed panels 64, 64' of the access door 60 as they open can be any amount suitable to facilitate loading or unloading of cargo from the interior of the associated container device 10. In the embodiment depicted in the drawings, it is contemplated that the doors can swing from a closed position though a suitable arc to a position that defines an angle of at least 90 degrees in relation to a plane $P_1$ defined by and through the structural frame 62. In the embodiment as depicted, the hinge element (s) 76 are configured and positioned so that they interact with the mating hinge element(s) 78 in a manner that can facilitate a degree of travel in an arc of approximately 180 degrees from the closed position.

The side support bars 70, 72 can have any suitable geometry and configuration to provide suitable structural support to the structural frame and/or the associated container device 10 in at least one of the collapsed and uncollapsed orientations. In the embodiment depicted in the FIGS. 1 and 2, the side support bars 70, 72 have a central region configured to support the associated structural frame 62 and door panels appended thereto. The central region can have any suitable cross section geometry as desired or required. In various embodiments, it is contemplated that the central region of the side support bars 70, 72 will have a suitable rectilinear cross section geometry with mounting surface 74 forming one face of the rectilinear geometry.

The central region of side support bars 70, 72 can also include a suitably configured flange 80 that projects outward from the respective side support bar 70, 72 at a location opposed to the hinge element 76. The flange 80 can extend any suitable length at least along the central region of the side support bar 70, 72 and may contiguously extend to regions of the side support bars 70, 72 to elements immediately contiguous to the central region, if desired or required. The lip or flange 80 projects from the side support bars 70, 72 of the structural frame 62 in an orientation that extends toward the elongated sides 102, 102' of base member 12 when the respective endwalls 18, 20 are in the perpendicular or first orientation. The flange 80 is configured to extend a measured distance beyond the body 82 of side support bar 70, 72 to provide a contact surface for the corresponding respective opposed side member 48, 50 when the associated sidewall 14, 16 is in the perpendicular position.

The side support bars 70, 72 can also include a suitable lower pediment 84 and an upper pediment 86 that are both connected to the central region of the side support bars. In various embodiments such as the embodiment depicted in FIGS. 1 and 2, it is contemplated that the lower pediment 84 and upper pediment 86 can be reinforced and can have a general rectilinear geometry with an essentially rectilinear cross section that is greater than that of the corresponding central region. The flange 80 can contiguously extend and be connected at least one of the upper pediment 86 and the lower pediment 84 as desired or required.

The lower pediment 84 can be configured to removably engage a suitably configured corner region of the base member 12 when the associated endwall 18, 20 is in the perpendicular orientation. The side support bars 70, 72 can also include an upper pediment 86 configured to releasably connect to a mating region of the base member of a mating overlying container device. In the embodiment as depicted, each upper pediment 86 includes a suitable projection such as frustoconical region 88 that protrudes above each of the four corners of the uncollapsed container device 10. The projection is configured to be removably insertable into a suitably configured region located in the lower surface of the base member of a mating container device 10'. In this way multiple container devices can be positioned in secure stacked relationship with one another as desired or required.

It is contemplated that the structural frame 62 can also be configured to means for orienting the associated endwall 18, 20 perpendicular to the base member 12. It is contemplated that such orienting means can include various suitable upright supports to assist in maintaining the associated endwall 18, 20 in the perpendicular position during the container assembly process and/or the container device 10 in the uncollapsed position.

Figure 6:
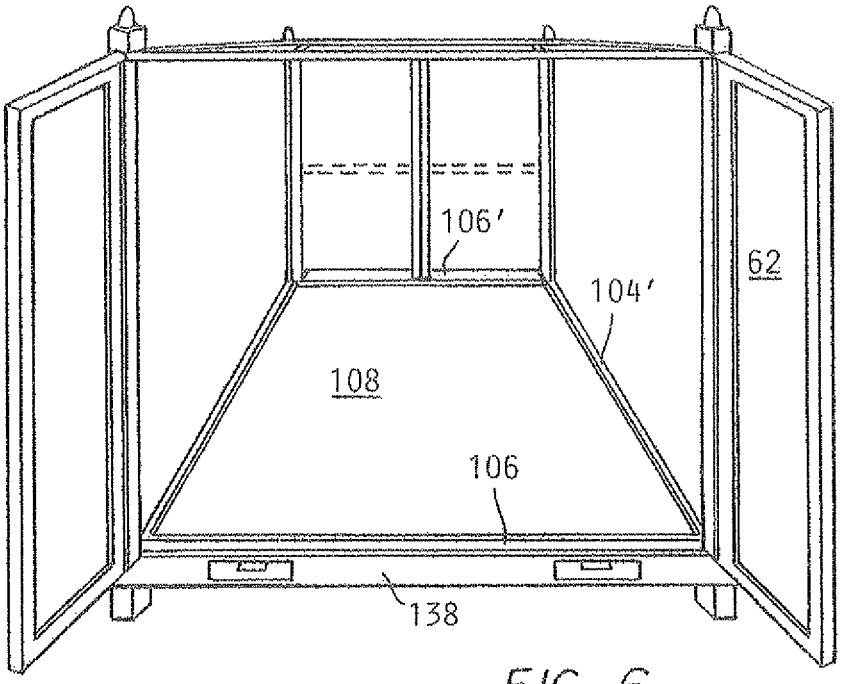
FIG. 6 is a side view of an embodiment of the container device as depicted herein with one set of doors in the open state.
Figure 7:
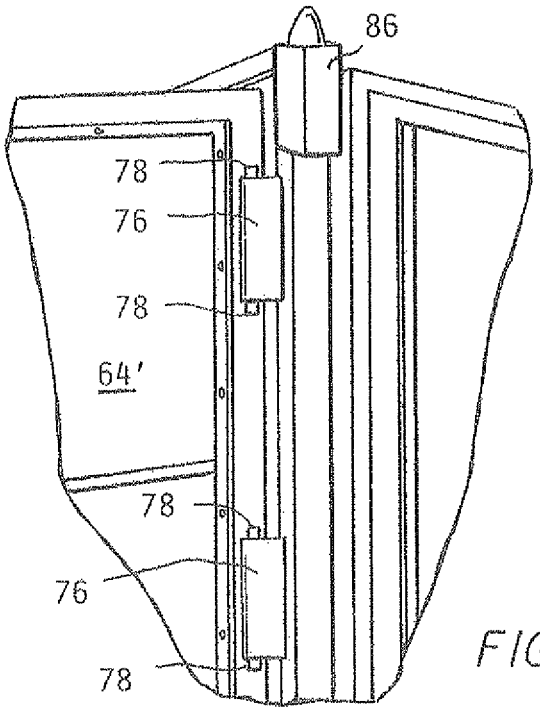
FIG. 7 is a detail view of a door hinge configuration in one embodiment of the container device as depicted herein.
Figure 8:
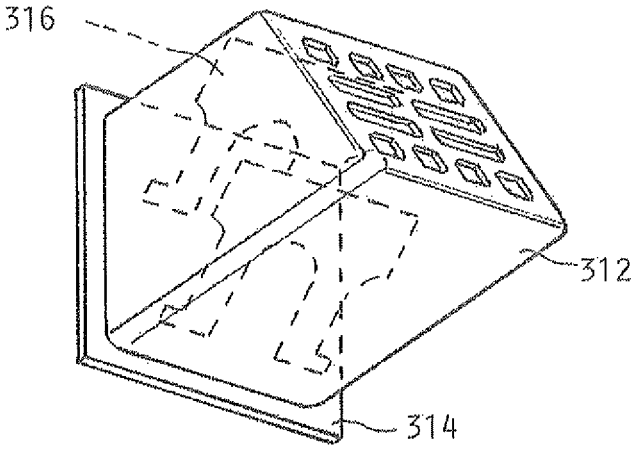
FIG. 8 is a detail view an embodiment of the bumper device for use on the container device as disclosed herein.
Figure 10:
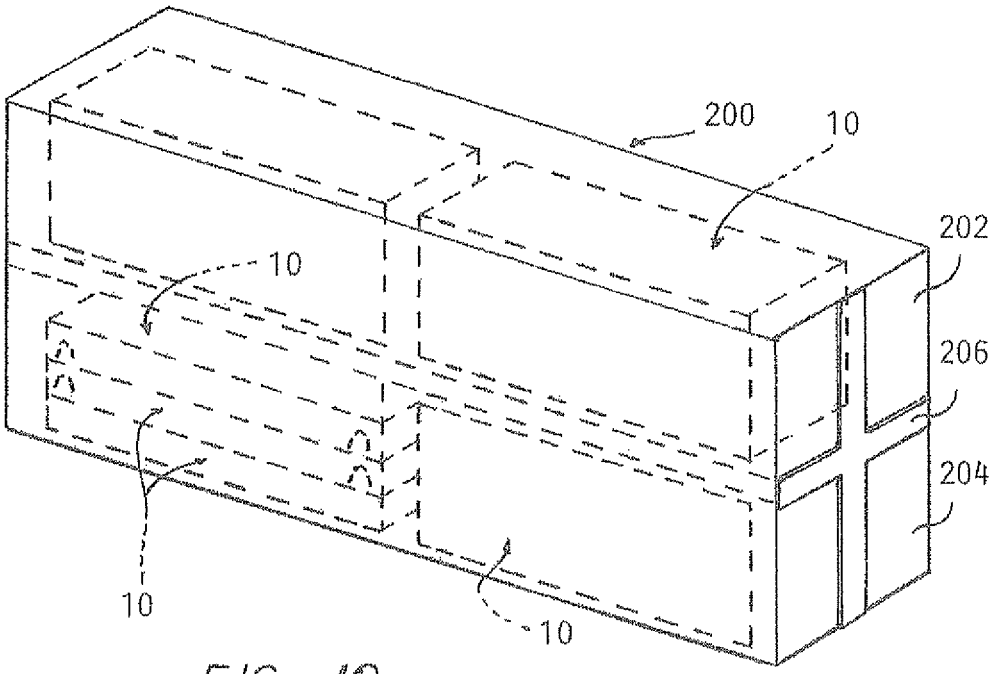
FIG. 10 is a schematic view of a representative rail car with an embodiment of the container as disclosed herein.
Figure 9A:
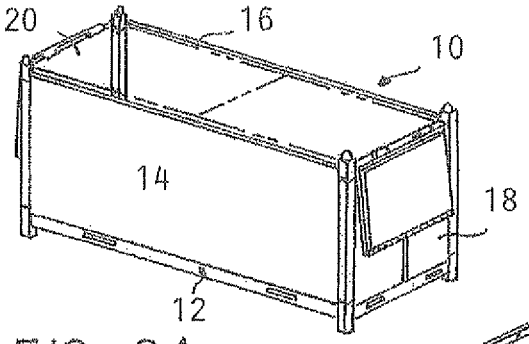
FIG. 9 is a sequential depiction of the collapse process of an embodiment as disclosed hereinwith the final collapsed container in the stacked configuration.
Figure 9B:
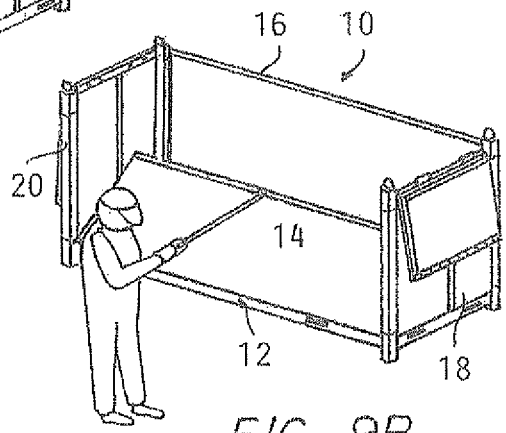
Figure 9C:
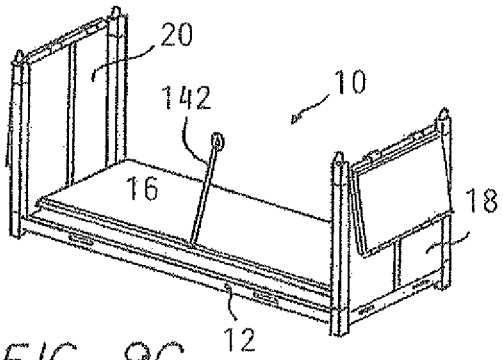
Figure 9D:
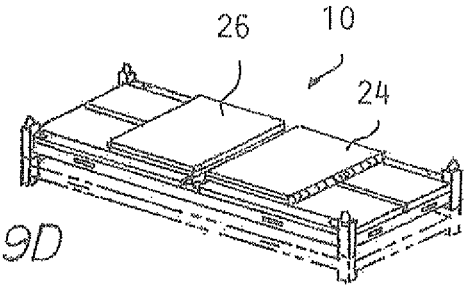
Figure 11:
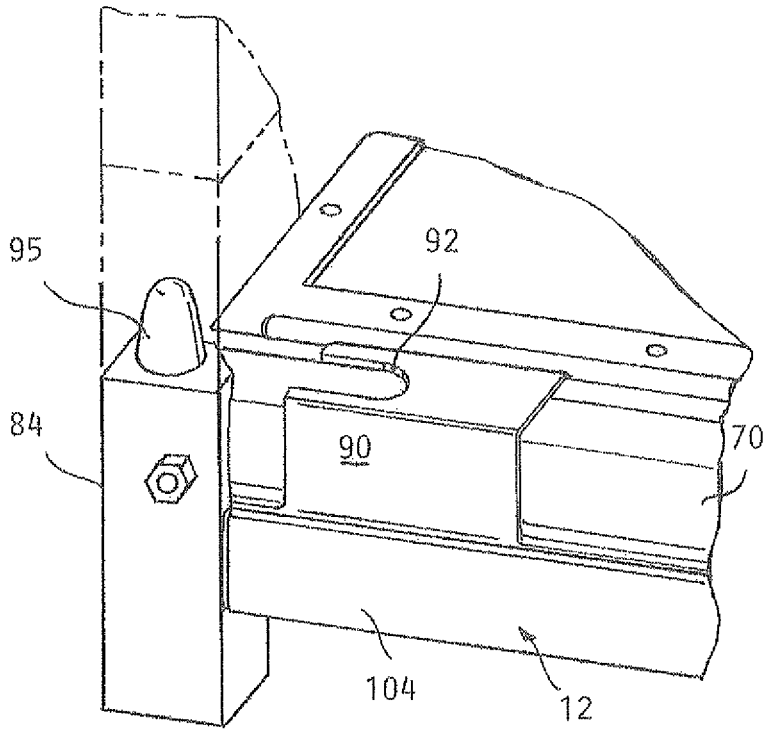
FIG. 11 is a detail drawing of a door wall interior of an embodiment of the container as disclosed herein.
Figure 12:
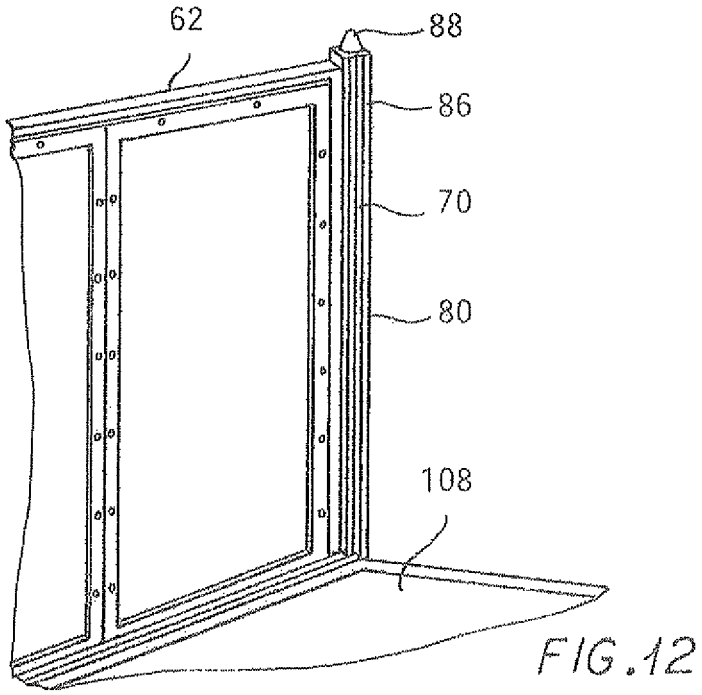
FIG. 12 is a detail drawing of a corner portion of an embodiment of the container as disclosed herein.

In the embodiment as shown in FIG. 6 and 18, lower pediment 84 is configured to include a lowermost region 90 having a slot-like aperture 92 in communication with a hollow region 94 that is configured to releasably communicate with a suitable anchoring pin 96 protruding from the associated corner region of the base member 12. The anchoring pin 95 can have any suitable configuration. In the embodiment as depicted in FIG. 6, the anchoring pin is a frustoconical projection that is configured to be removably positionable in the hollow region 94.

The lower pediment 84 has a lower surface 98 configured to engage the region proximate to that anchoring pin 96 when the endwall 18, 20 is in the perpendicular orientation. The lower lateral bar 66 is connected to the respective side support bars 70, 72 at any location that will permit pivotal movement of the associated end wall relative to the base member 12. It is contemplated that in certain embodiments, the lower lateral bar of the structural frame 62 connects to the side support bars 70, 72 at the region adjacent to or immediately below the lowermost surface 98 of lower pediment 84 in a manner that will be discussed subsequently.

The opposed upper lateral bar 68 of structural frame 62 is connected to the side support bars 70, 74 at a location proximate to the upper region of the support bars when the structural frame 62 and the associated endwall is in the perpendicular orientation. In the embodiment as depicted, the opposed upper lateral bar 68 is contiguously connected between opposed pediment members 86. The opposed upper lateral bar 68 is generally an elongated rectangular rod having a generally rectilinear cross section.

It is contemplated that a suitable roof panel of roof member 22 such as roof panel 24 or roof panel 26 can be pivotally connected to the opposed upper lateral bar 68 of structural frame 62 in any suitable manner. In one embodiment, it is contemplated that the associated roof panel 24, 26 can be connected to the structural frame 62 by means of at least one hinge member 96. Hinge member 96 can be located on and attached to a suitable face defined on the opposed upper lateral bar 68. The suitable face can be one that will upwardly oriented when the structural frame 62 is in the perpendicular position. Hinge member 96 can be a single element or can be multiple elements in space relationship to one another on the upper lateral bar 68.

Hinge member 96 communicates with the mating hinge member 98 associated with the respective roof panel 22, 24. The hinge assembly 96, 98 is configured to permit and facilitate rotation of the associated roof panel 24, 26 through a suitable arc between a the first uncollapsed orientation where the respective roof panels 22, 24 are in perpendicular contact with the associated sidewalls 14, 16 to an orientation where the roof panels 24, 26 facilitate positioning of the various elements in the second collapsed orientation. In the embodiment depicted in that FIGS. 1 and 2, the respective roof panels can rotate through a 270° arc that commences when the respective roof panel 22,24 engages the perpendicular sidewalls 14, 16 and terminates when the roof panel 24, 26 is in a position essentially parallel with the outwardly facing surface of the perpendicular endwall 18, 20.

Where desired or required, the structural frame 62 can also include or communicate with suitable stop members that prohibit the inward rotation of the associated access door 60. In certain embodiments, these stop members can be tabs extending inward from the opposed upper lateral bar 68 or side support bars 70, 72 of structural frame 62. It is also contemplated that the lower lateral bar 66 of the structural frame can be configured or positioned in a manner that limits inward travel of the associated door panels 64, 64' of access door 60.

It is also contemplated that the structural frame 62 can include various additional features and element to position the respective door elements and/or facilitate locking and the like. In various embodiments, it is contemplated that elements of the structural frame 62 such as the lower lateral bar 66 and the opposed upper lateral bar 68 can be configured with suitable slots apertures and/or lock sets to releasably receive locking bolts, slides, and the like to maintain the respective opposed panels 64, 64' of access door 60 in the appropriate closed position. One suitable lock-and-latch system is depicted in the drawing figures as latch 102 associated with lock mechanism 67.

When the container device 10 is in the uncollapsed or in-use configuration, endwalls 18 and 20 are pivotally connected to the base member 12 and are oriented in a perpendicular position relative to base member 12. The endwalls 18, 20 can be constrained over-rotation by interaction of the respective lower pediments 84 in the manner described subsequently. It is also contemplated that constraint from over-rotation can occur as a result of the interaction between the lower lateral bar 66, the associated lower hinge and the base member 12. In the uncollapsed or in-use configuration, sidewalls 14 and 16 are also in perpendicular orientation relative to the base member 12. Sidewalls 14, 16 can be supported in the perpendicular orientation and constrained from over-rotation beyond perpendicular by the respective flange member 80 located on the associated respective side support bars 70,72 of the structural frame 62 of the respective endwalls 18, 20.

Perpendicular orientation of the respective endwalls 18,20 can be maintained, at least temporarily, by the configuration of and interaction with lower pediment 84 of each of the respective side support bars, 70, 72 associated with structural frame 62 of endwalls 18, 20. Extension of a suitably configured projection 95 extending upward from the base member 12 and received in the hollow region 94 of lower pediment 86 can be utilized to maintain the associated structural frame 62 in a perpendicular position for an interval sufficient to engage and orient the respective sidewalls 14, 16.

Once the sidewall members 14, 16 are in perpendicular orientation, it is contemplated that the interposition of the respective sidewalls 14, 16 will further brace the associated endwalls 18, 20 and prevent reversion of the endwalls back to the collapsed orientation. It is also contemplated that any inward pressure exerted on the sidewalls 14, 16 by endwalls 18,20 may also serve to maintain the sidewalls 14, 16 in the perpendicular orientation during subsequent stages of the container re-assembly process.

The various elements of the container device 10 can be further maintained in position relative to one another by the action of the roof member 22. In the embodiment as depicted herein, roof member 22 is composed of roof panels 24, 26 attached to respective endwalls 18, 20. When the respective roof panels 24, 26 are in position overlying the base member 12 to define the interior cavity of the container device 10, side elements 40 can be brought into overlying engagement with the associated region upper region of the respective sidewalls 14, 16. This engagement helps to define the container, prevent visual and/or physical ingress into the interior cavity and further constrains pivotal movement of the associated sidewalls 14, 16 out of perpendicular orientation. In the embodiments depicted, the side elements 40 are configured to receive associated regions of upper side support member 52 in mating relationship. Other engagement mechanisms and means can also be employed in certain specific instances.

As indicated previously, the respective roof panels 24, 26 are attached to the structural frame 62 and are pivotally moveable relative thereto by the configuration and action of respective mating hinge members 96, 98. When each respective roof panel 24, 26 is in the first or in use position, the side elements of the roof member 40 are in overlying engagement with the upper side support element 52 of the respective sidewall 14, 16. The respective end elements 42, 42' of the associated roof panels 24, 26 can be configured to matingly engage with each other as by a suitable "glad hands" coupled relationship. (seen particularly in FIG. 1A). In the embodiment depicted in the drawing figures, end elements 42 of the respective roof panels 24, 26 are configured as elongated mating elements of two respective glad-hand coupling mechanisms. Thus, when the roof member 22 is in the first or in-use position, the respective side elements 40 of the roof member act to secure and maintain the associated sidewalls 14, 16 in the perpendicular position. The end elements 42, 42' of the respective roof panels 24, 26 couple with one another to prevent or restrict rotational movement of the respective roof panels 24, 26 when oriented in the in use position. In certain embodiments, it is also contemplated that the configuration of the respective end elements 42 and/or the coupling action between the end elements 42, 42' of the respective roof panels 24, 26 can also serve to reinforce the central region of the roof member 22 and can further constrain the sidewalls from movement away from perpendicular. It is also contemplated that the interaction between the respective end elements 42, 42' serves as a brace that can constrain movement of the associated endwalls 18, 20 away from perpendicular.

Where desired or required, it is contemplated that various removable through bolts or other suitable fastening means can be employed to maintain or ensure that the various elements remain in suitable orientation to one another.

The base member 12 can have any suitable dimensions and geometry as desired or required to correspond to that various elements previously enumerated. The base member 12 will generally have dimensions and structure sufficient to support the various wall elements pivotally attached there to and to provide structure and support for the associated container device 10 in the both the collapsed and the uncollapsed orientations. In the embodiments depicted in various the drawing figures, the base member 12 generally has a rectangular configuration. The base member 12 has opposed elongated sides 104, 104' as well as opposed truncated sides 106, 106' defining a suitable central floor region 108. In the embodiment depicted in the drawing figures, the base member 12 is composed of a frame 110 that is configured to contain and secure a suitable central floor member 112 in the defined central floor region 108.

The frame 110 can be composed of any suitable structural and load bearing material such as various types of structural steel. It is contemplated that material suitable for the frame 112 will be materials that are both lightweight and durable. The materials of choice will be ones that resist torque and bending and provide a suitable support for the various other components of the container device 10 in both the collapsed and uncollapsed orientations.

In the embodiment as depicted in the drawing figures, frame 110 includes opposed elongate beams 114, 116 contiguously joined to truncate beams 118, 112 to define a suitable rectangular structure. In the embodiment depicted in the drawing figures, the respective elongate beams 114, 116 and truncate beams 118, 120 are connected to suitably configured end posts 122 to define the suitable rectangular structure.

The end posts 122 can have any suitable configuration and geometry. In the embodiment as depicted in the drawing figures, the end posts 122 project upwardly from the plane $P_2$ generally defined by elongate beams 114, 116 and truncate beams 118, 120.

The frame 110 may also include suitable foot members 124. The foot members 124 may be to the frame at any suitable location. In the embodiment depicted in the drawings, the foot members 124 project downwardly from the lower side of the frame 112 at a location proximate to the location of the respective end posts 122.

While the frame 110 can have any suitable dimensions, it is generally contemplated in many applications that the width of the truncate beams 118, 120 will be one that generally corresponds to the tire-to-tire width of a passenger vehicle. The general dimensions of the frame as well as the dimensions of the associated container device in its collapsed and uncollapsed dimensions is generally that which can be readily positioned in associated car hauling container devices. It can be appreciated that the maximum dimensions for the container device 10 will generally be governed by the industry standards applicable for passenger vehicles in many embodiments of the container device disclosed herein. However it is considered with in the purview of this disclosure to employ other dimensions as desired or required for use in suitably configured car hauling containers.

By way of non-limiting example, it is contemplated that certain embodiments can have a frame 110 of any suitable dimension; however, a length of approximately 85 inches to 110 inches and a width of approximately 40 to 55 inches is generally contemplated by the present disclosure. The maximum height of the container device 10 in the uncollapsed state is generally between about 40 inches and about 60 inches. The height in the collapsed state will generally be between about 10% and 30% the uncollapsed height of the container device 10 with all or a major portion of the collapsed height being the dimensions of the base member 12.

In an embodiment as depicted in the drawing figures, the end posts 122 of frame 110 can be configured to releasably position and receive associated or additional container devices in stacked overlying relationship to one another when the respective container devices are is in the collapsed orientation. In an embodiment as disclosed, the end posts 122 are configured with an upwardly projecting frustoconical pin 96. As discussed previously, the lower pediment 84 of the associated side support bar 70, 72 can releasably engage the frustoconical pin 96 when the associated endwall 18, 20 of the container device 10 is in the perpendicular orientation. When the container device 10 is in the collapsed orientation, the frustoconical pin 96 can be releasably received into suitably configured opening defined in the respective foot element 124 of an associated container device 10'.

Where desired or required, the frame 110 can have suitable supports and intermediate braces in order to ensure structural stability. It is also contemplated that suitable apertures or slots 132 can be defined in elongate beams 114, 116 as well as in truncate beams 118, 120. The slots can be configured to releasably receive suitable lifting tines as would be found on a forklift or other suitable pallet-loading devices.

Where desired or required, the frame and associated end posts 122 can be configured to further delimit and/or maintain the various sidewalls 14, 16 and endwalls 18, 20 in the perpendicular position until pivotally relocated into the collapsed position. These features can include various side extensions projecting contiguously upward from associated elongated beam 114, 116. In general, the frame will be configured so as to removably receive at least some of the collapsed elements into a space defined within the frame 110. In this manner, when the various elements such as the sidewalls 114, 116, endwalls 118, 120, and roof panels 24, 26 are positioned in the collapsed orientation, these elements are at least partially protected from damage and jostling by the associated frame 110.

It is contemplated that a plurality of collapsed container devices 10 can be stacked one on top of the other such as in the manner depicted in the drawing figures. While the precise number of collapsed container devices 10 that can be stacked one on top of the other varies depending upon application, it is contemplated that in collapsible storage container devices such as the one depicted and disclosed herein, as many as five or six collapsed container devices can be stacked one upon the other. The general limitation on the maximum number of collapsed container devices that can be stacked one on top of the other will generally be determined by dimensional requirements and/or weight requirements and limitations for transporting the stacked containers in a suitable car hauling device such as a double deck car transporting rail car. In general, the number of stacked collapsible containers will generally be that number that approximates the uncollapsed height of one container device. Thus, between five and seven containers can be stacked in the collapsed state in certain embodiments of the device as disclosed herein.

When multiple collapsed container devices 10 are stacked, the respective feet and endpost units are stacked and intermeshed one on top of the other to form corner support pillar assemblies 128 that provide structure to the assembled stack and anchor the individual collapsed container devices into a unitary assembly for storage and/or transport to locations where they are needed.

The associated stacked units cooperatively form at least one shelf-like slot 130. The shelf-like slot can be defined by a respective frame 110 and its immediate adjacent mating frame 110'. The slot 130 has sufficient height, width, and length to contain the respective collapsed sidewalls 14, 16, endwalls 18, 20, and roof member 22 securely and safely within the assembly defined by frames 110, 110'. In this manner, all moveable elements of the collapsible container are secured and maintained in a protected relationship to prevent or minimize damage to one or more moveable members during storage and/or transport.

The resulting assembly of collapsed container devices 10 can be transported by any suitable transportation modality. In the embodiment as depicted herein, each frame 110 includes a plurality of slots 132 that are configured to releasably engage handling forks on a suitable forklift transportation device. Where the collapsed assembly is to be transported, the forked members can be removably inserted into the mating slots 132 of the lowest frame 110. In this manner, the entire assembly of collapsed containers can be moved from place to place as desired or required.

It is contemplated that various frame slots can be positioned in the frame at suitable locations. In the embodiment as depicted, frame slots 132 are suitably located in both the truncated beams 118, 120 and in the elongated beams 114, 116.

Where it is desired to remove one collapsed container device from the associated stack, the appropriate transport device such as a forklift can be removably inserted into the slots of the associated device to lift and move that device from contact with the stack. When it is necessary to reconstruct or uncollapse the removed container device, the associated sidewalls 14, 16 and endwalls 18, 20 can be pivoted from the second storage position to a perpendicular location as discussed previously.

In an embodiment of container device 10 as depicted herein, it is contemplated that the sequence of reconstruction can be as follows. Endwalls 18, 20 with roof panels in parallel relationship are pivoted via hinge member 96 into temporarily perpendicular relationship to the base 12.

Temporary perpendicular positioning can be accomplished and maintained by any suitable means or device. As a non-limiting example, in an embodiment depicted herein, a hinge member 96 that is configured to facilitate the temporary positioning of the respective endwall 18, 20 in perpendicular relationship during the assembly process. Hinge member 96 is composed of lower pediment 84 and interacts and helps define lower lateral bar 66. The hinge member 96 includes central rod 134. The central rod 134 is located interior and upward of what becomes the lower end of lower level bar 66. The central rod 134 can be positioned within a suitably configured shaft defined in or associated with the lower lateral bar 66.

When the endwall 18, 20 is pivoted, it is contemplated that the endwall will pivot around central rod 134 into a position in which the surface of lower lateral bar 66 overlies an associated region of the base member 12. The pivotal relationship also brings the lower pediment 84 into engagement with the frustoconical element 95 defined on the end post 122 of frame 110 of base member 12. It is contemplated that the lowermost region 90 of the lower pediment 84 will be brought into contacting relationship with the uppermost region of end post 122 with the frustoconical element 95 received though aperture 92 and contained in hollow region 94 of the lower pediment 84. It is contemplated that this engagement as well as over-center rotational feature in potential combination with the weight and dimensions of the associated end wall 18, 20 can act to maintain the associated endwall 18,20 in essentially perpendicular relationship with the base member 12 during the rest of the assembly process. Where desired or required, additional bracing may be employed. This additional temporary bracing may include, but is not limited to, manually holding the associated end wall during the assembly process as well as other temporary bracing devices as would be desired or required.

It is also contemplate that the central rod 34 and associated shaft 138 can be configured to define a suitable stop member to prevent or limit inward travel of access door 60, such as the pivotal inward travel of opposed panels 64, 64'. Where the shaft assembly is as described, it is contemplated that other stops could be eliminated or minimized.

It is contemplated that the slot 134 can extend beyond the associated lower lateral bar 66 and can be pivotally received in the base member 12. In the embodiment disclosed herein, the central rod 134 is pivotally received in a suitable aperture defined in the associated end post 122 of base member 12. The central rod 134 can be pivotally received and fastened the base member 12 by any suitable means. In an embodiment depicted herein, the central rod 134 is bolt fastened. It is contemplated that the entire associated endwall assembly is contained and pivoted around the structural frame 62. Thus, access doors 60, such as is defined by opposed panels 64, 64' can be removably fastened relative to the structural frame 62 to ensure that these elements pivot as a unit into the perpendicular position.

Once the end walls 18, 20 are in perpendicular relationship relative to base member 12, the sidewalls 14, 16 can also be pivoted upward into perpendicular relationship around suitable hinge elements 140 that connect the respective sidewall 14, 16 to the base member 12 at a location proximate to the respective elongated beam 118, 120. Pivotal movement of the respective sidewalls 14, 16 brings them into mating relationship with associated flanges 80 defined on the respective structural supports 62. This mating relationship provides intermediate support for the perpendicular relationship of the respective end walls 18, 20 as well as the side walls 14,16. It is contemplated that the interaction of the endwalls 18, 20 with respective sidewalls 14, 16 will provide mutual bracing of these respective elements during the remainder of the assembly process.

After the sidewalls 14, 16 have been placed in perpendicular orientation, the roof panels 24, 26 can be rotated from the parallel as stored position into engagement with the top portion of the side walls 14, 16 so that the side elements 40 of the associated roof panels 24, 26 engage the upper side support member 52 of the associated sidewalls 14, 16. The end elements 42 of the respective roof panels 24, 26 can be matingly engaged also. In this fashion, the sidewalls are maintained in perpendicular relationship relative to the base member 12.

The collapsible containers can be employed in various car healing containers including but not limited to rail cars, automotive transport vehicles and various shipping containers. A generic container device is depicted in FIG. 17 as 200. The device has two levels 202, 204 divided by a support shelf 204 on which the upper level of cars can be supported. The container 200 is configured to transport assembled automotive vehicles such as passenger cars from import locations and/or assembly plants to points of sale.

As depicted in FIG. 17 the generic container 200 is dimensioned to contain for vehicles or four container devices 10 suitably and stably anchored relative to the respective container support floor. Other sizes of container device are contemplated and can be expected. The collapsible container device in either the collapsed or uncollapsed orientation can be anchored in the car hauling container in an suitable manner. Suitable anchor devices can be those typically employed in car hauling operations configured to engage the lead end of the lower portion of the container device in a manner similar to tire engagement on a transported vehicle. A non-limiting example of such as device is described in U.S. Pat. No. 5,302,063 to Windsor, the disclosure and specification of which is incorporated in its entirety herein.

It is contemplated that the restraint or wheel chock as disclosed in the Windsor patent can be modified as desired or required such as in the manner outlined in FIG. 15. The modification depicted in FIG. 15 is attachable to the forward or tire engaging portion of the chock in any suitable manner and includes an anchor 310 engageable with an angled bumper 312.

It is contemplated that the flat rear panel 314 of the anchor 310 can be affixed to that leading end of the associated chock in any suitable fashion. The anchor 310 can be made of any suitable material of which various structural metal are considered exemplary. In the embodiment depicted, the anchor includes outwardly protruding slots 316. The slots are configured to be matingly received in the angled bumper 312 in a suitable manner such as that shown in phantom in FIG. 15.

The angled bumper can have any suitable configuration that permits engagement with the leading surface of the container device proximate to its lower region. As depicted, the bumper has a plurality of slots and apertures and can be constructed of a suitable material to engage, absorb, dissipate and/or transmit forward impact force generated by nay forward momentum of collapsible container devices in the car hauling container device due to events such as aggressive stops and the like. Non-limiting examples of suitable materials include materials such as various natural and synthetic rubber and the like.

It is contemplated that the device depicted in FIG. 15 can be affixed to a suitable gate lock chock device and the modified chock device anchored in the wheel trough defined in the car hauling container (not shown). The lower most regions or feet of the associated container device can be positioned in the parallel wheel troughs and can be brought into engagement with suitable leading faces of the bumper portions 312 of anchor devices 310. The chocks can be locked into engagement in the troughs and forward motion restrained. It is also contemplated that, where desired or required, the rearward portions of the associated container device can be similarly restrained. In this manner the collapsible container can be securely anchored in the associated car hauling device In the depiction set forth in FIG. 17, the car hauling container device includes four exemplary containers 10 and one stack of collapsed containers "S". It is contemplated that the stack can be anchored in any suitable manner such as that previously described. It is also contemplated that the car hauling device can be utilized to haul collapsed or uncollapsed container automobiles simultaneously if desired or required.

The collapsible container devices disclosed herein can be used to transport any suitable material or cargo. It is contemplated that the containers can be loaded with various automotive assembles and subassemblies of which engine blocks are but one non-limiting example. While the container can be employed to transport any of a number of devices, it is believed that the collapsible container device can be advantageously employed to develop a closed circuit transport system utilizing under-used transport vehicles to transport cargo in addition to finished vehicles either simultaneously to the vehicle transport in on return dead headed trips. This system would have a number of advantages that may include greater fuel economy and reduced environmental impact, reduced transport costs, and greater manufacturing efficiency.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed:

1. A container device for transporting at least one automotive vehicle and at least one unassembled automotive vehicular part, the device comprising:

at least one rail or shipping container defining an interior space, the interior space having at least two car supporting surfaces in overlying relationship to one another, the car supporting surfaces configured to removably position and maintain a plurality of automotive vehicles during transport; and at least one collapsible container configured to be removably positionable in at least one of the automotive vehicle positions defined in the car supporting surface, the collapsible container including a base member configured to engage the vehicle supporting floor of an automobile and hauling container;

a pair of opposed sidewalls, pivotally mounted to the base moveable between a first orientation perpendicular to the base and a second orientation in overlapping relationship to each other and to the base member;

a pair of opposed endwalls pivotally mounted to the base, moveable between a first orientation perpendicular to the base and a second orientation in overlying relationship to the sidewalls and in side-by-side relationship to each other;

a roof member pivotally attached to at least one of the end wall or side walls and moveable between a first position in overlying spaced relationship from the base member and essentially perpendicular relationship to the respective end walls and side walls and a second collapsed position.

2. The container device of claim 1 wherein the base member comprises:

at least one locking member, the locking member connected to the base member and releasably attachable to the associated car-hauling container to fixedly position the container device relative thereto, and a plurality of leg members connected to the base and extending downward therefrom, the leg members configured to alternately contact the vehicle supporting floor or a mating member an associated container device.

3. The container device of claim 1 wherein the sidewalls each comprise:

a central region;

a reinforced peripheral region in communication with the central region, at least one attachment mechanism located on a lower face of the reinforced peripheral region, the attachment mechanism pivotally attaching the side wall to the base, wherein the peripheral region is configured to cooperatively interact with the end walls to position the respective side wall in an orientation perpendicular to the base member in the use position.

4. The container device of claim 3 wherein the end walls each comprise:

a central region;

a reinforced peripheral region, the reinforced peripheral region including side members, the side members of the peripheral region of the end walls are configured to contact at least a portion of the peripheral region of the respective side walls and to retain the sidewalls in respective upright orientations; and at least one attachment mechanism connected to a lower face of the reinforced peripheral region pivotally attaching the respective endwall to the base.

5. The container device of claim 4 wherein at least one of the end walls and side walls comprises a closable access portal.

6. The container device of claim 5 wherein the access portal is a door member pivotally mounted with a peripheral support region of at least one end wall.

7. The container device of claim 1 further comprising at least one roof member, the roof member having at least one central region and at least one peripheral support region, the roof member movable between a collapsed and an uncollapsed position, wherein the roof member is movably connected to at least one of the sidewalls and the endwalls and is releasably engageable with the remaining side walls and end walls when the container is in the uncollapsed position.

* * * * *